US008684618B2

(12) United States Patent
Lai

(10) Patent No.: US 8,684,618 B2
(45) Date of Patent: Apr. 1, 2014

(54) TWO SIDE WRITING FOUNTAIN PEN

(76) Inventor: Yee-Shang Lai, Hualien (TW)

( * ) Notice: Subject to any disclaimer, the term of this patent is extended or adjusted under 35 U.S.C. 154(b) by 0 days.

(21) Appl. No.: 13/608,815

(22) Filed: Sep. 10, 2012

(65) Prior Publication Data

US 2013/0322953 A1 Dec. 5, 2013

(30) Foreign Application Priority Data

May 31, 2012 (TW) ..... 101210488 A

(51) Int. Cl.
*B43K 5/02* (2006.01)
*B43K 1/04* (2006.01)

(52) U.S. Cl.
CPC ..... *B43K 1/04* (2013.01)
USPC ..... 401/222; 401/221; 401/231; 401/232; 401/240

(58) Field of Classification Search
USPC ..... 401/221, 222, 231, 232, 233, 236, 239, 401/240, 242, 249, 250, 251, 253, 256
See application file for complete search history.

(56) References Cited

U.S. PATENT DOCUMENTS

| | | | | | |
|---|---|---|---|---|---|
| 2,935,968 | A * | 5/1960 | Morse et al. | ..... | 401/227 |
| 3,606,556 | A * | 9/1971 | Green et al. | ..... | 401/231 |
| 4,474,487 | A * | 10/1984 | Malamoud | ..... | 401/231 |
| 5,222,824 | A * | 6/1993 | Nicoll et al. | ..... | 401/235 |
| 6,652,177 | B2 * | 11/2003 | Shimada et al. | ..... | 401/233 |

* cited by examiner

*Primary Examiner* — David Walczak
*Assistant Examiner* — Joshua Wiljanen
(74) *Attorney, Agent, or Firm* — Meagher Emanuel Laks Goldberg & Liao, LLP

(57) ABSTRACT

The two-side writing fountain pen of the present invention comprises an ink output means and a holding means which is provided for fastening the ink output means, and said ink output means includes a pen nib member and a feed member. The pen nib member includes a pen nib flake and a pen tip granulation element formed at the tip of the pen nib flake, wherein the pen tip granulation element is formed with a pen tip front contact section, a pen tip back contact section and an ink output passage communicating with the pen tip front contact section and the pen tip back contact section, and then the pen nib flake is provided with an ink guiding passage communicating with the ink output passage. The feed member includes an ink input section and an ink output section, said ink input section is provided within the holding means, and the ink output section connects with the ink guiding passage of the pen nib flake.

7 Claims, 5 Drawing Sheets

TWO SIDE WRITING FOUNTAIN PEN

FIELD OF THE INVENTION

The present invention relates to a fountain pen, and more particularly to a fountain pen which has a two side writing effect

BACKGROUND OF THE INVENTION

Generally, a fountain pen, with a head structure, has been used to write or sign documents. The head structure of fountain pen primarily includes a hood, a feed and a nib. The front end of the feed is provided with the triangular-shaped sharp member, and the back end of the feed is provided with a joint section. The shaft surface of the feed is allocated with several annularly aerating fins. The upper/bottom surfaces of the shaft are respectively provided with a diversion slip and an aerating slot. The nib is attached to an upper surface of a sharp member, which is in front of the nib, and a sleeve is used to cover the feed and the nib by a sleeve. Thereafter, an ink cartridge may be inserted at the end of the fountain pen head to form a whole foundation pen.

However, in the conventional foundation pen, the diversion slip of the front nib is the major output passage of the ink, and the diversion slip of the back nib is closed to disable it from writing when the pen is pressed in the side of back nib. Therefore, it is a disadvantage that the foundation pen is only allowed to write in the side of front nib, but not in the side of back nib. Thus, if the front nib is used in a long term of time, the sharp portion of the front nib is easy to worn to cause deformation and disable it from writing.

Finally, the sharp portion, which contacts a paper, in the conventional fountain pen, is not processed to be grounded or slipped. This causes a coarse nib that will easily scratch the paper surface or block the outflow of ink in writing.

SUMMARY OF THE INVENTION

The present invention is to overcome the above mentioned problems of the conventional foundation pen by providing a fountain pen which has two-side writing effect.

The two-side writing fountain pen of the present invention comprises an ink output means and a holding means which is provided for fastening the ink output means, and said ink output means includes a pen nib member and a feed member. The pen nib member includes a pen nib flake and a pen tip granulation element formed at the tip of the pen nib flake, wherein the pen tip granulation element is formed with a pen tip front contact section, a pen tip back contact section and an ink output passage communicating with the pen tip front contact section and the pen tip back contact section, and then the pen nib flake is provided with an ink guiding passage communicating with the ink output passage. The feed member includes an ink input section and an ink output section, said ink input section is provided within the holding means, and the ink output section connects with the ink guiding passage of the pen nib flake.

In a preferred embodiment of the present invention, the pen nib member has a guiding airflow hole formed in the pen nib flake, and one end of the ink guiding passage communicates with the guiding airflow hole.

In a preferred embodiment of the present invention, the pen tip front contact section and the pen tip back contact section respectively have a pair of arched smooth contact surfaces formed at both sides of exit surface of the ink output passage.

In a preferred embodiment of the present invention, the total length of the arched surface of the arched smooth contact surface is approximately a quarter of the total surface length of the pen tip granulation element.

In a preferred embodiment of the present invention, the opening angle of the ink output passage of the pen tip back contact section is approximately between 0°20'0" to 0°30'0".

In a preferred embodiment of the present invention, the feed member has an ink circulation member, and the two end of the ink circulation member respectively connect with the ink input section and the ink output section.

In a preferred embodiment of the present invention, the holding means includes a front barrel member and a barrel member, and the front barrel member is provided for fastening the ink output means by combining with the barrel member.

In a preferred embodiment of the present invention, the holding means further includes an ink holding member provided between the front barrel member and the barrel member, and one end of the ink holding member communicates with the ink input section of the feed member.

By means of technical means of this present invention, a pen tip granulation element is formed at the tip of the pen nib flake. The pen tip granulation element has a pen tip front contact section, a pen tip back contact section and an ink output passage. The ink output passage communicates the pen tip front contact section and the pen tip back contact section. Therefore, user can write in two sides, and the fountain pen is provided with two kinds of width of the handwriting because of the angle of the ink output passage. Moreover, the present invention improves the drawbacks of the prior art that we write only with one side nib for a long time so that the nib becomes worn because of the pressure, causing deformation and disabling the nib from writing.

Moreover, the pen tip front contact section and the pen tip back contact section individually have a pair of arched smooth contact surfaces formed at both sides of exit surface of the ink output passage, and thus the part of the conventional fountain pen which contacts a paper has been ground, so the nib is not coarse. Therefore, the problem that the nib will easily scratch the paper or block the outflow when people are overexert writing is improved.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
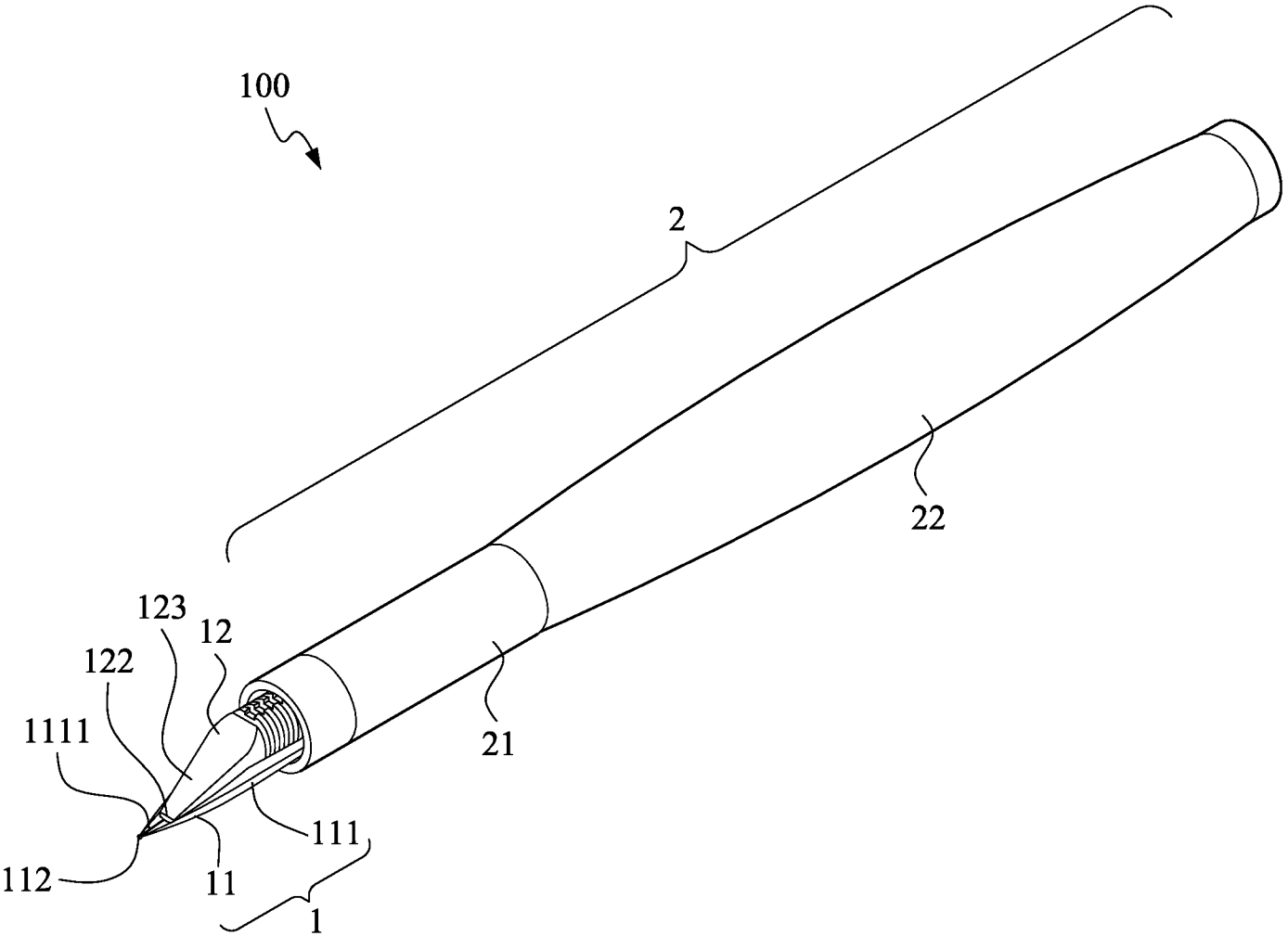
FIG. 1 is a stereogram illustrating the fountain pen according to the present invention.
Figure 2:
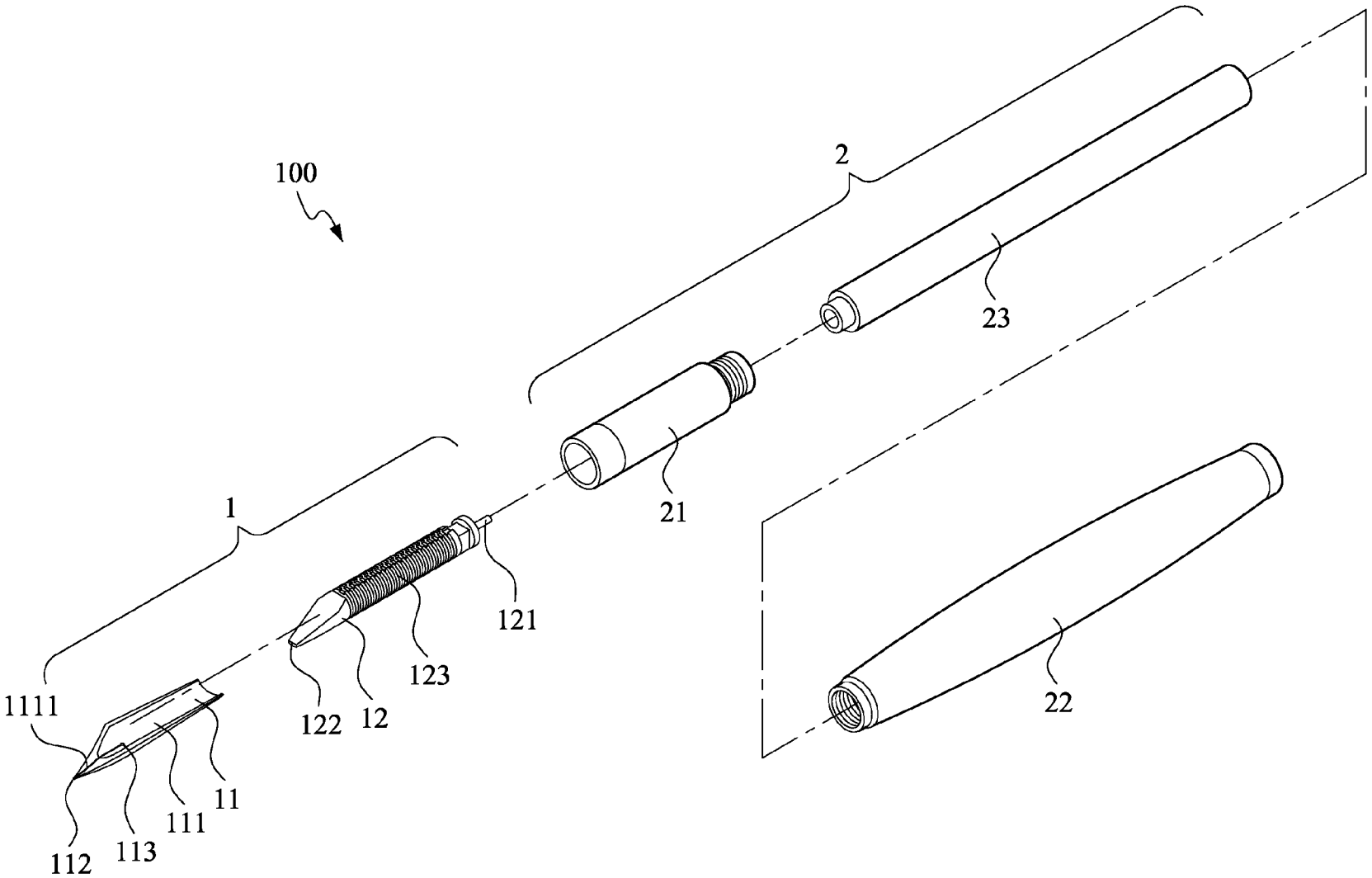
FIG. 2 is an explosion diagram illustrating the fountain pen according to the present invention.
Figure 3A:
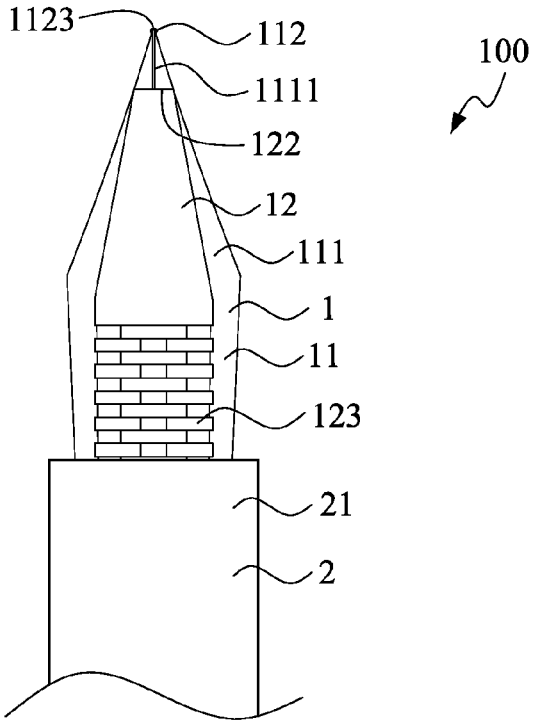
FIG. 3A is a front view illustrating the fountain pen in part according to the present invention.
Figure 3B:
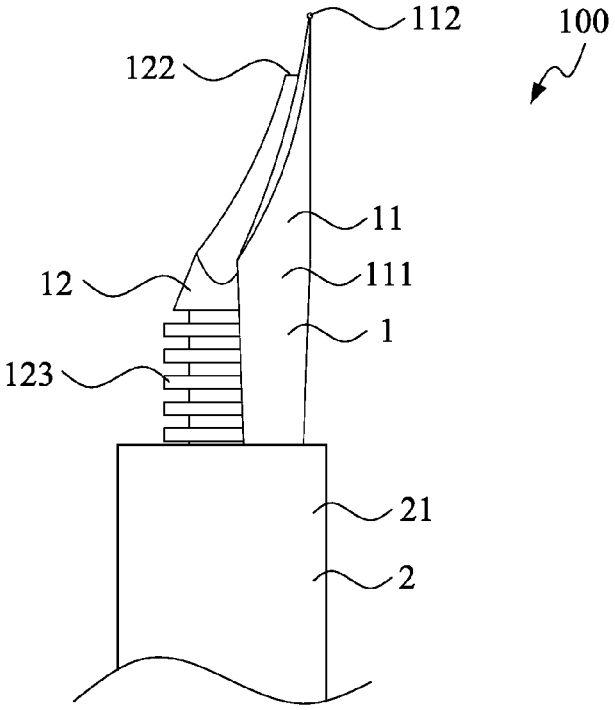
FIG. 3B is a side view illustrating the fountain pen in part according to the present invention.
Figure 3C:
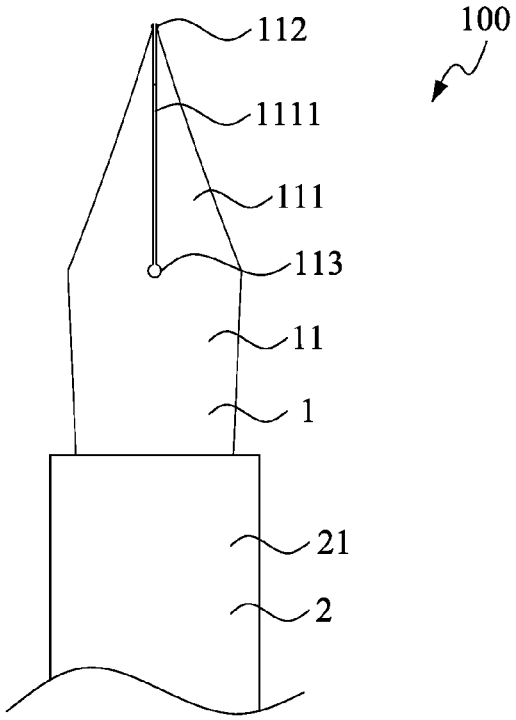
FIG. 3C is a back view illustrating the fountain pen in part according to the present invention.
Figure 4:
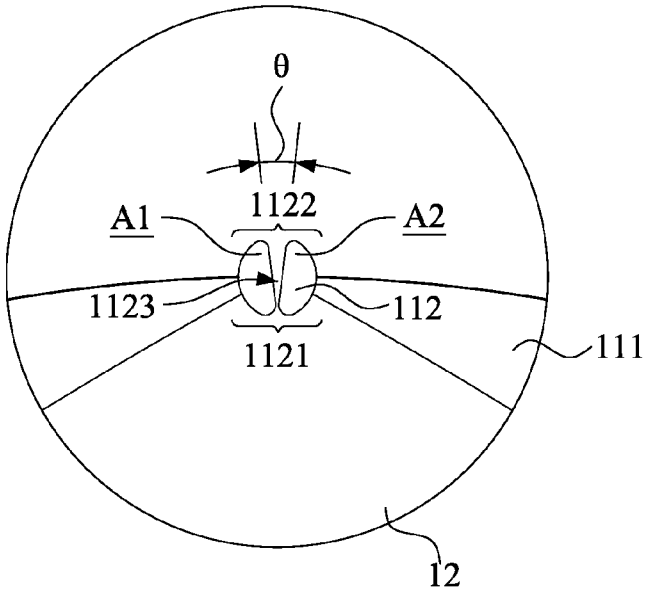
FIG. 4 is an enlarged diagram illustrating the fountain pen in part according to the present invention.

A fountain pen 100 of the present invention is shown in FIG. 1 to FIG. 4. FIG. 1 is a stereogram illustrating the fountain pen according to the present invention. FIG. 2 is an explosion diagram illustrating the fountain pen according to the present invention. FIG. 3A is a front view illustrating the fountain pen in part according to the present invention. FIG. 3B is a side view illustrating the fountain pen in part according to the present invention. FIG. 3C is a back view illustrating the fountain pen in part according to the present invention. FIG. 4 is an enlarged diagram illustrating the fountain pen in part according to the present invention.

A fountain pen 100 of the present invention includes an ink output means 1 and a holding means 2, which is provided for fastening the ink output means 1. The ink output means 1 includes a pen nib member 11 and a feed member 12. The pen nib member 11 has a pen nib flake 111, a pen tip granulation element 112 which is formed at the tip of the pen nib flake 111, and a guiding airflow hole 113 which is formed in the pen nib flake 111. The pen tip granulation element 112 has a pen tip front contact section 1121, a pen tip back contact section 1122 and an ink output passage 1123. The ink output passage 1123 communicates with the pen tip front contact section 1121 and the pen tip back contact section 1122, and then the pen nib flake 111 has an ink guiding passage 1111 which communicates with the ink output passage 1123. The end of the ink guiding passage 1111 communicates with the guiding airflow hole 113. The guiding airflow hole 113 is an air flowing slit, which is used not only for flowing air to balance the air pressure, but also avoid the concentrated stress applied that will enlarge the width of slit of the nib. Besides, the ink output passage 1123 and the ink guiding passage 1111 are both very small slit, that are acting for playing role of capillary action.

In the present invention, the pen tip front contact section 112 and the pen tip back contact section 1122 respectively have a pair of arched smooth contact surfaces A1, A2, formed on both sides of the outer surface of the ink output passage 1123. Each of the arched smooth contact surfaces A1, A2 has been ground as a smooth surface with a grinding degree of 0.03 mm. Further, the total surface length of each arched smooth contact surfaces A1, A2 is approximately a quarter of the total surface length of the pen tip granulation element 112. And then the opening angle θ of the ink output passage 1123 of the pen tip back contact section 1122 is approximately between 0°20'0" to 0°30'0". The opening angle θ gradually decreases from the end of the pen tip back contact section 1122 to the end of the pen tip front contact section 1121. The structure prevents the ink output passage 1123 from closing when writing at the pen tip back contact section. Of course, the above-mentioned values, such as the grinding degree of 0.03 mm and the opening angle θ of approximately between 0°20'0" to 0°30'0", are the preferred values but not limits to these.

Further, the feed member 12 has an ink input section 121, an ink output section 122 and an ink circulation member 123, wherein the ends of the ink circulation member 123 are respectively connect the ink input section 121 and the ink output section 122. The ink input section 121 is provided within the holding means 2, and the ink output section 122 is connected with the ink guiding passage 1111 of the pen nib flake 111. As shown in the FIG. 2, the holding means 2 includes a front barrel member 21 and a barrel member 22, and then the front barrel member 21 is provided for fastening the ink output means 1 by combining with the barrel member 22. Further, the holding means 2 further includes an ink holding member 23. The ink holding member 23 is provided within the front barrel member 21 and the barrel member 22 is provided with one end thereof connecting with the ink input section 121 of the feed member 12.

Figure 5A:
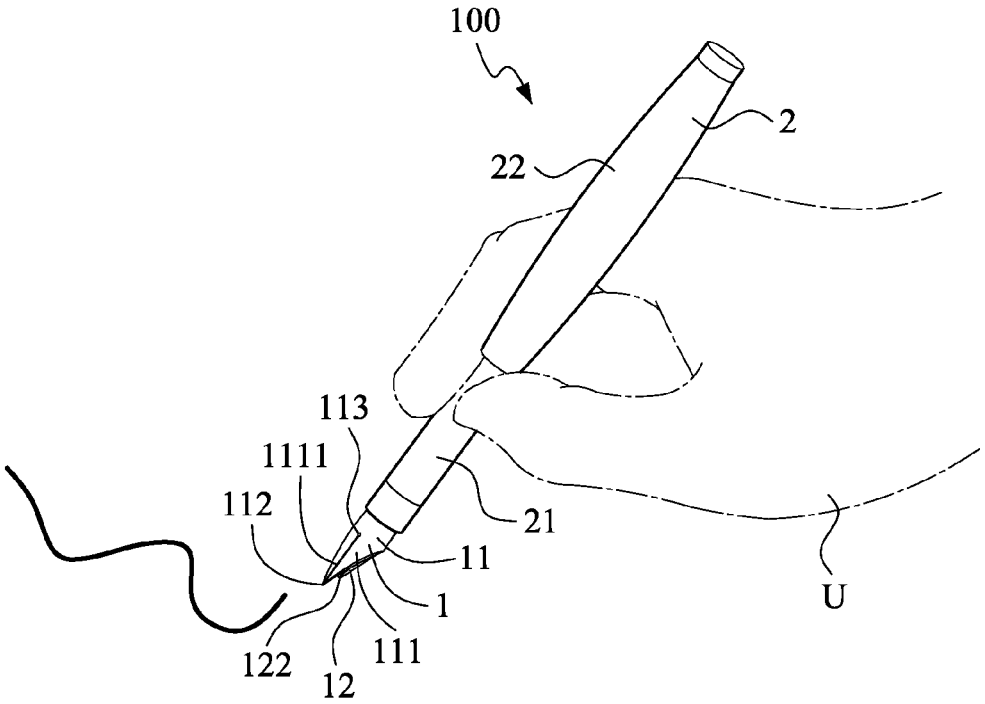
FIG. 5A is an application diagram illustrating the fountain pen according to the present invention.
Figure 5B:
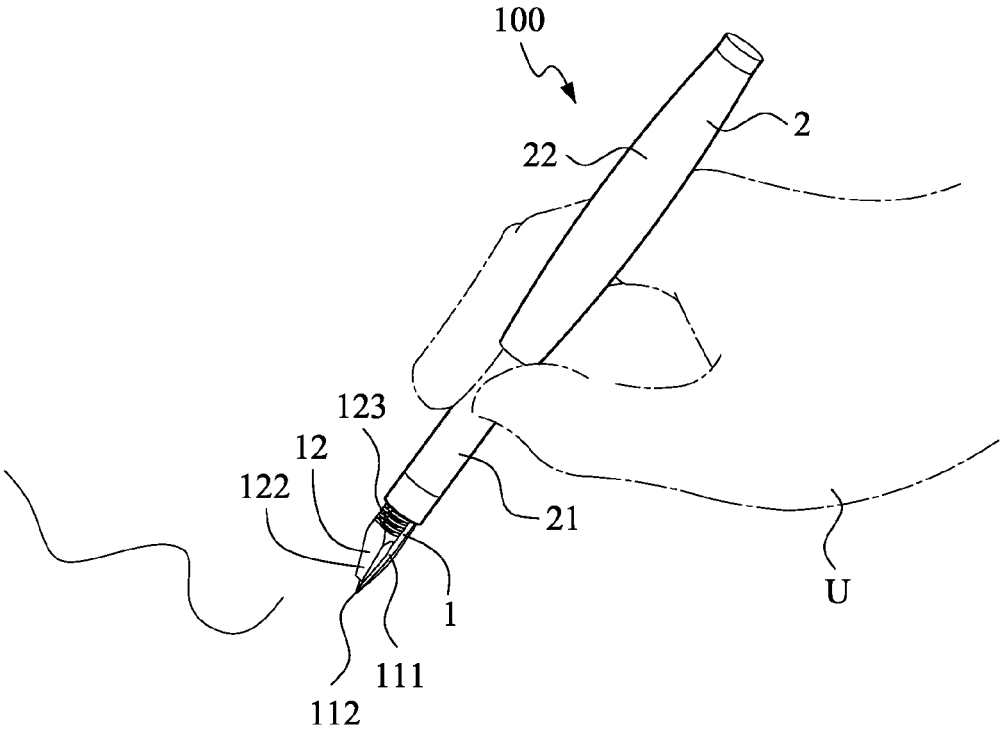
FIG. 5B is another application diagram illustrating the fountain pen according to the present invention.

Refer to FIG. 5A and FIG. 5B. FIG. 5A is an application diagram illustrating the fountain pen according to the present invention. FIG. 5B is another application diagram illustrating the fountain pen according to the present invention. When a user U uses the fountain pen 100 of the present invention to write in the front side, the ink which is stored in the ink holding member 23 is inputted from the ink input section 121 of the feed member 12, and flows through the ink circulation member 123 and the ink output section 122 in a sequence, and then flows through the ink guiding passage 1111 to the ink output passage 1123 of the pen tip front contact section 1121. Similarly, when a user U uses the fountain pen 100 of the present invention to write in the back side, the ink which is stored in the ink holding member 23 is inputted from the ink input section 121 of the feed member 12, and flows through the ink circulation member 123 and the ink output section 122 sequentially, and then flows through the ink guiding passage 1111 to the ink output passage 1123 of the pen tip back contact section 1122. Because the opening angle of the pen tip front contact section 1121 and the opening angle of the pen tip back contact section 1122 are different in which the opening angle of the ink output passage 1123 of the pen tip front contact section 1121 is smaller, and the opening angle of the ink output passage 1123 of the pen tip back contact section 1122 is larger, so in this embodiment, when a user U uses the fountain pen 100 of the present invention to write in the back side, the larger opening angle in the pen tip back section 1122 allows the flow of ink. As the result, a user can write in the back side.

Further, if the pen tip front contact section 1121 of the pen tip granulation element 112 is ground to make a larger contact area, the width of the written word thicker. And if the contact area of the pen tip front contact section 1121 is larger, the pen tip back contact section 1122 is therefore smaller, based on the reason that the total area is the same, to make the width of the written word sharper in the back side writing.

In the operation, the variety kinds of width of the word written in the present invention include three kinds as follows. (1) The pen tip front contact section 1121 is ground to make a large contact area and the width of the handwriting is thicker; (2) the pen tip back contact section 1122 is sharp with a smaller contact area to have a thinner width of the handwriting; (3) the contact area of the pen tip back contact section 1122 and the contact area of the pen tip front contact section 1121 are the same, and thus the width of the handwriting are the same.

From the above description, we can know that the width of the handwriting is determined according to the area where the pen tip granulation element contacts the paper, and the amount of outputting ink cannot determine the width of the handwriting, but with a very little affection.

As can be appreciated from the above embodiments, the fountain pen of the present invention has industry worth which meets the requirement for a patent. The above description should be considered as only the discussion of the preferred embodiments of the present invention. However, a person skilled in the art may make various modifications to the present invention. Those modifications still fall within the spirit and scope defined by the appended claims.

What is claimed is:

1. A two-side writing fountain pen, comprising:

an ink output means; and a holding means which is provided for fastening the ink output means, said ink output means comprising:

a pen nib member comprising a pen nib flake and a pen tip granulation element formed at the tip of the pen nib flake, wherein the pen tip granulation element is formed with a pen tip front contact section, a pen tip back contact section, and an ink output passage communicating with the pen tip front contact section and the pen tip back contact section, and the pen nib flake is provided with an ink guiding passage communicating with the ink output passage, wherein the opening angle of the ink output passage of the pen tip back contact section is approximately between 0°20'0" to 0°30'0"; and a feed member comprising an ink input section and an ink output section, said ink input section being provided within the holding means, and the ink output section connecting with the ink guiding passage of the pen nib flake.

2. The two-side writing fountain pen as claimed in claim 1, wherein the pen nib member has a guiding airflow hole formed in the pen nib flake, and one end of the ink guiding passage communicates with the guiding airflow hole.

3. The two-side writing fountain pen as claimed in claim 1, wherein the pen tip front contact section and the pen tip back contact section respectively have a pair of arched smooth contact surfaces formed at both sides of an exit surface of the ink output passage.

4. The two-side writing fountain pen as claimed in claim 3, wherein the total length of the arched surface of the arched smooth contact surface is approximately a quarter of the total surface length of the pen tip granulation element.

5. The two-side writing fountain pen as claimed in claim 1, wherein the feed member has an ink circulation member, and two ends of the ink circulation member respectively connect with the ink input section and the ink output section.

6. The two-side writing fountain pen as claimed in claim 1, wherein the holding means includes a front barrel member and a barrel member, and the front barrel member is provided for fastening the ink output means by combining with the barrel member.

7. The two-side writing fountain pen as claimed in claim 6, wherein the holding means further includes an ink holding member provided between the front barrel member and the barrel member, and one end of the ink holding member communicates with the ink input section of the feed member.

* * * * *